US010258161B2

(12) United States Patent
Kumazawa

(10) Patent No.: US 10,258,161 B2
(45) Date of Patent: Apr. 16, 2019

(54) CHAIR WITH POSITIONING MEMBER

(71) Applicant: Aichi Co., Ltd., Nagoya-shi, Aichi-ken (JP)

(72) Inventor: Taku Kumazawa, Ichinomiya (JP)

(73) Assignee: AICHI CO., LTD., Nagoya-shi (JP)

( * ) Notice: Subject to any disclaimer, the term of this patent is extended or adjusted under 35 U.S.C. 154(b) by 0 days.

(21) Appl. No.: 15/843,784

(22) Filed: Dec. 15, 2017

(65) Prior Publication Data

US 2018/0103762 A1 Apr. 19, 2018

Related U.S. Application Data

(62) Division of application No. 14/676,382, filed on Apr. 1, 2015, now Pat. No. 9,872,567.

(30) Foreign Application Priority Data

Apr. 3, 2014 (JP) ..... 2014-076803
Nov. 19, 2014 (JP) ..... 2014-234674

(51) Int. Cl.
*A47C 3/04* (2006.01)
*A47C 4/28* (2006.01)
(Continued)

(52) U.S. Cl.
CPC ..... *A47C 3/045* (2013.01); *A47C 4/04* (2013.01); *A47C 4/28* (2013.01); *A47C 7/56* (2013.01)

(58) Field of Classification Search
CPC .. A47C 4/28; A47C 3/045; A47C 7/56; A47C 4/04
(Continued)

(56) References Cited

U.S. PATENT DOCUMENTS 1,993,530 A 3/1935 Schaffer
2,838,094 A 6/1958 Janning
(Continued)

FOREIGN PATENT DOCUMENTS

CN 2776460 Y 5/2006
GB 928202 A 6/1963
(Continued)

OTHER PUBLICATIONS

Examination Report for European Patent Application No. 15162290.9 dated Jan. 15, 2018 (4 pages).
(Continued)

*Primary Examiner* — Milton Nelson, Jr.
(74) *Attorney, Agent, or Firm* — Withrow & Terranova, P.L.L.C.; Vincent K. Gustafson

(57) ABSTRACT

A chair in one aspect of the present invention comprises a leg body and a seat body. The leg body comprises a support frame that supports the seat body. The seat body comprises a frame body and a sheet-like member stretched across the frame body. The frame body has a positioning member provided on a back surface thereof that positions the seat body to be in a seatable state. An amount of protrusion of the positioning member is defined so that the positioning member contacts the frame body while a lowest part of the sheet-like member at the time the sheet-like member is deformed when a user sits down on the seat body is located above a top of the support frame.

9 Claims, 10 Drawing Sheets

(51) Int. Cl.
*A47C 7/56* (2006.01)
*A47C 4/04* (2006.01)

(58) Field of Classification Search
USPC ..... 297/445.1
See application file for complete search history.

(56) References Cited

U.S. PATENT DOCUMENTS

| | | | | |
|---|---|---|---|---|
| 3,087,755 | A | 4/1963 | Boman | |
| 5,393,126 | A | 2/1995 | Boulva | |
| 6,755,468 | B1 * | 6/2004 | Pan | 297/335 |
| 7,108,330 | B2 | 9/2006 | Mizelle et al. | |
| 7,152,929 | B2 | 12/2006 | Wu | |
| 7,314,252 | B2 * | 1/2008 | Ohliv et al. | 297/463.1 |
| 7,708,349 | B2 * | 5/2010 | Chen | 297/448.1 |
| 7,850,241 | B1 | 12/2010 | Lucci et al. | |
| 8,540,315 | B2 * | 9/2013 | Piretti | 297/335 |
| 2006/0055220 | A1 | 3/2006 | Heidmann et al. | |
| 2007/0267911 | A1 | 11/2007 | Kinoshita et al. | |
| 2008/0106136 | A1 | 5/2008 | Heidmann et al. | |
| 2008/0315661 | A1 | 12/2008 | Lin | |
| 2010/0194160 | A1 * | 8/2010 | Machael et al. | 297/239 |
| 2010/0327643 | A1 | 12/2010 | Lucci et al. | |
| 2015/0282622 | A1 | 10/2015 | Kumazawa | |

FOREIGN PATENT DOCUMENTS

| | | | | |
|---|---|---|---|---|
| JP | 2005218534 | A | | 8/2005 |
| JP | 2005279032 | A | | 10/2005 |
| JP | 2007135624 | A | | 6/2007 |
| JP | 2008-113937 | A | | 5/2008 |
| JP | 2011136101 | A | | 7/2011 |
| KR | 2013-0079727 | A | | 7/2013 |
| KR | 20130079727 | A | * | 7/2013 |
| WO | 2012060462 | A1 | | 5/2012 |

OTHER PUBLICATIONS

Extended European Search Report for European Patent Application No. 15162290.9 dated Sep. 29, 2015 (5 pages).
Official Action (Communication pursuant to Article 94(3) EPC) for European Patent Application No. 15162290.9 dated Jul. 26, 2016 (4 pages).
Notice of Allowance for U.S. Appl. No. 14/676,382 dated Sep. 18, 2017 (5 pages).
Office Action for U.S. Appl. No. 14/676,382 dated Apr. 28, 2017 (5 pages).
Final Office Action for U.S. Appl. No. 14/676,382 dated Dec. 7, 2016 (13 pages).
Office Action for U.S. Appl. No. 14/676,382 dated Jun. 29, 2016 (10 pages).
Final Office Action for U.S. Appl. No. 14/676,382 dated Mar. 21, 2016 (12 pages).
Office Action for U.S. Appl. No. 14/676,382 dated Nov. 19, 2015 (9 pages).
Offical Action (Communication pursuant to Article 94(3) EPC) for European Patent Application No. 15162290.9 dated Mar. 27, 2017 (4 pages).
Notice of Reason(s) for Rejection for Japanese Patent Application No. 2014-234674 dated Jul. 10, 2018 (7 pages including English translation).
First Office Action for Chinese Patent Application No. 2015101549260, dated Nov. 1, 2018, 15 pages.
Notification of Reasons for Refusal for Japanese Patent Application No. 2014-234674, dated Oct. 30, 2018, 9 pages.

* cited by examiner

CHAIR WITH POSITIONING MEMBER

CROSS-REFERENCE TO RELATED APPLICATIONS

This application is a divisional of U.S. patent application Ser. No. 14/676,382 filed Apr. 1, 2015 and subsequently issued as U.S. Pat. No. 9,872,567 on Jan. 23, 2018, which claims benefit of Japanese Patent Application No. 2014-076803 filed Apr. 3, 2014 in the Japan Patent Office and Japanese Patent Application No. 2014-234674 filed Nov. 19, 2014 in the Japan Patent Office, wherein the disclosures of all of the foregoing applications and patent are hereby incorporated by reference herein.

BACKGROUND

The present invention relates to a chair that comprises a leg body and a seat body.

A chair is conventionally known, as a chair to be used in a hall, etc., that can be stacked in a front-rear direction for storage while its seat body is flipped up in order to reduce storage space for the chair when it is not in use.

It is common for this type of chair to position the seat body by means of a frame extending in a left-right direction in an upper part of the leg body so as not only to permit more compact storage of the chair in a stored state but also to ensure a sufficient strength of the chair (see, for example, JP2005-279032 and JP2005-218534).

Further, from the viewpoint of seating comfort, the seat body comprises a sheet-like member stretched across the frame body to thereby enhance seating comfort of the chair.

SUMMARY

The techniques described in the above patent documents employ a structure in which a frame provided directly under the seat body receives the load to maintain compactness of the chair. In this case, downward deformation of the sheet-like member caused when a user sits down on the seat body can lead the sheet-like member to contact the frame. This can result in reduced seating comfort.

It is preferable, in an aspect of the present invention, to improve the seating comfort of the chair without reducing the compactness thereof in a stored state.

Means for Solving the Problem

A chair in one aspect of the present invention comprises a leg body and a seat body. The leg body comprises a support frame that supports the seat body. The seat body comprises a frame body having a frame-like shape and a sheet-like member stretched across the frame body. The frame body has a positioning member provided on a back surface thereof that protrudes from the back surface to contact the support frame, thereby positioning the seat body to be in a seatable state. An amount of protrusion of the positioning member is defined so as to maintain a state in which a lowest part of the sheet-like member at the time the sheet-like member is deformed when a user sits down on the seat body is above a top of the support frame.

According to the chair configured as such, even in a case where it has a support frame provided directly under the seat body to ensure the compactness, the lowest part of the sheet-like member at the time the sheet-like member is deformed when the user sits down on the seat body does not contact the support frame. Thus, the deformation of the sheet-like member is not hindered by the support frame when the user sits down. In other words, the sheet-like member can be deformed to its maximum extent according to the load (the weight of the user who sits down). Hence, no deterioration in the seating comfort of the chair occurs; accordingly, the comfort of the user can be ensured. In this way, the seating comfort of the chair can be enhanced while the compactness thereof in a stored state is maintained.

Now, a position that corresponds to ischial tuberosities of a seated person, specifically a position where ischial tuberosities of a seated person are assumed to be located can be the position of the center of gravity of the seated person. Thus, it is effective that the load is received in a region, on the back surface of the frame body, extending forward and backward from a reference position that is the position corresponding to the ischial tuberosities of the seated person so as to ensure the strength of the chair when the user sits down.

According to a chair in another aspect of the present invention, the positioning member may comprise a set of protruding pieces, one protruding piece protruding from a front end and the other protruding piece protruding from a rear end of a given region including the reference position on the back surface of the frame body, and a connecting piece that connects the set of protruding pieces to each other so that positioning of the seat body is achieved by contact of the connecting piece with the support frame.

According to a chair in still another aspect of the present invention, the positioning member may be configured as a plate-like protrusion that protrudes from a given region including the reference position on the back surface of the frame body.

Such a chair can receive the load by means of the positioning member in a region of the seat body that can include the position of the center of gravity of the seated person. This can advantageously ensure the strength of the chair when the user sits down.

Especially, the configuration in which the positioning member comprises the set of protruding pieces and the connecting piece allows elastic deformation of the positioning member to easily occur because of this frame-like structure. For example, a design of the positioning member in which the positioning member is elastically deformed only by a load that exceeds the load applied while the user is seated permits the chair to have the function of absorbing a large load caused when the user sits down.

According to a chair in still another aspect of the present invention, the positioning member may have a shape in which a front-rear width thereof is made narrower toward a far side from the seat body. An upper surface of the support frame may comprise a contact surface with the positioning member, and the support frame may be provided so that part thereof contacts or intersects a line extended along a line corresponding to a front end of the positioning member in a side view.

According to the chair configured as such, since the front-rear width of the positioning member is made narrower toward the far side from the seat body, the front-rear width of the area of the support frame that contacts the positioning member can also be reduced according to the front-rear width of the positioning member, and thus, the compactness of the chair can further be improved when it is stored.

According to a chair in still another aspect of the present invention, the positioning member may comprise an extended area extending forward in a side view and may have a shape in which a front-rear width thereof including the extended area is made narrower toward the far side from the seat body.

According to the chair configured as such, a front end of the positioning member including the extended area can support and, at the same time, reinforce a left side and/or a right side of the seat body from the back. In such a case, the strength of the seat body can be improved. The front end of the positioning member including the extended area functions to bend the seat body gradually more toward its front end. Thus, the deformation of the seat body caused by contact of the legs (especially, the back of the thighs) of the user who sits down is less likely to be hindered to result in increase in the seating comfort of the chair.

According to a chair in still another aspect of the present invention, the positioning member may comprise a pair of positioning members, and the chair may further comprise a reinforcing frame that connects the far side, from the seat body, of one of the pair of positioning members and the far side, from the seat body, of the other of the pair of positioning members to each other.

According to the chair configured as such, the reinforcing frame can further improve the strength of the chair.

According to a chair in still another aspect of the present invention, the support frame may have, on an upper surface thereof, an inward regulating piece that regulates an inward displacement of the positioning member in the left-right direction, the inward regulating piece being provided in an area that is in or adjacent to a contact area of the support frame with the positioning member.

According to a chair in still another aspect of the present invention, the support frame may have, on an upper surface thereof, an outward regulating piece that regulates an outward displacement of the positioning member in the left-right direction, the outward regulating piece being provided in an area that is in or adjacent to a contact area of the support frame with the positioning member.

The chair in these configurations has a regulating piece arranged in the area that is in or adjacent to the contact area with the positioning member, and thus the positional relationship between the regulating piece and the positioning member can be clarified. In such a case, the user can securely and easily position the seat body.

According to the configuration including the inward regulating piece, even in a case where the positioning member is displaced inward in the left-right direction by the load applied when the user sits down, the inner regulating piece regulates this displacement so that the strength of the chair at the time the user sits down is further improved.

According to the configuration including the outward regulating piece, even in a case where the positioning member is displaced outward in the left-right direction by the large load applied, for example, when the user sits down, the outer regulating piece regulates this displacement so that unintended deformation caused by such a load can be reduced.

According to a chair in still another aspect of the present invention, the positioning member may be configured to protrude from the back surface of the seat body in such a manner as to be inclined inward in the left-right direction so that the positioning member contacts the support frame at a position within an outer left side or an outer right side of the seat body.

According to the chair configured as such, the contact of the positioning member with the support frame at a position within the outer left side or the outer right side of the seat body secures a certain distance from the outer side to the contact area. This can result in reduced occurrence of an object being caught in the contact area.

According to a chair in still another aspect of the present invention, the seat body may be configured to be rotatable about an axis extending in the left-right direction on a rear side of the frame body.

BRIEF DESCRIPTION OF THE DRAWINGS

The present invention will now be described by way of exemplary embodiments with reference to the accompanying drawings, in which.

Figure 1A:
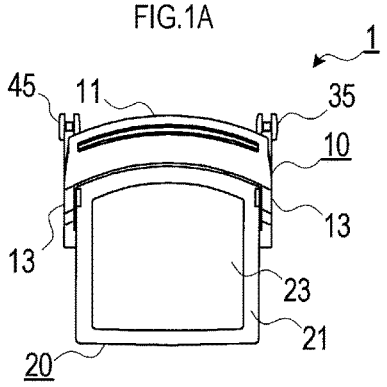
FIGS. 1A-1E are six views illustrating an entire configuration of a chair (a left side view is omitted)
Figure 1B:
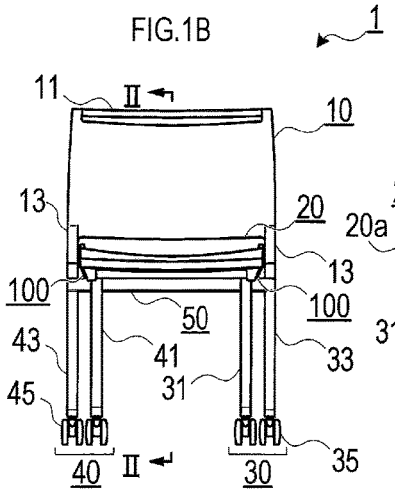
Figure 1C:
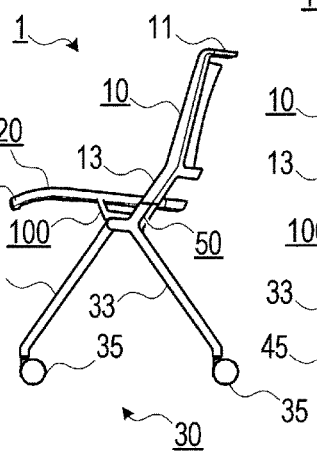
Figure 1D:
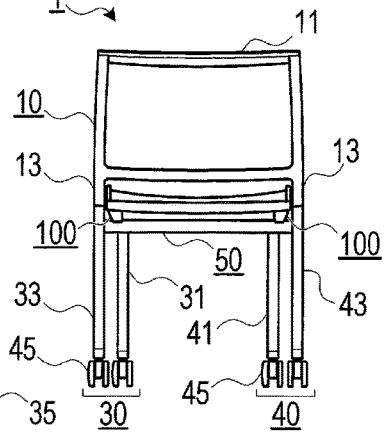
Figure 1E:
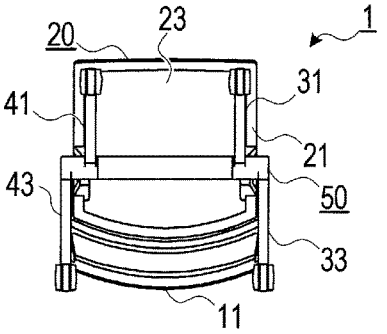

DETAILED DESCRIPTION OF THE PREFERRED EMBODIMENTS (1) Configuration

A chair 1 comprises a backrest 10, a seat body 20, a pair of left and right leg parts 30, 40, and a support frame 50 extending in a left-right direction as shown in FIGS. 1A-1E. A user can stack a plurality of the identical chairs 1 in a front-rear direction for storage (see FIG. 5).

The backrest 10 has a shape, on the whole, to fit along the back of a seated person. Specifically, the backrest 10 is a plate-like member in an arc-like shape being convex backward in a plan view. The backrest 10 comprises a strip-like piece 11 and a pair of backrest-side connecting pieces 13. The strip-like piece 11 extends backward from a top end of the backrest 10. The pair of backrest-side connecting pieces 13 extends downward from a bottom end of the backrest 10 to be connected to the support frame 50, one backrest-side connecting piece 13 from a left side and the other backrest-side connecting piece 13 from a right side of the bottom end of the backrest 10.

The strip-like piece 11 comprises two portions 11*a* and a portion 11*b*. The two portions 11*a* extend backward from the top end of the backrest 10, one portion 11*a* from a left side and the other portion 11*a* from a right side of the top end of the backrest 10. The portion 11*b* is a strip-like portion that connects the two portions 11*a* to each other in the left-right direction. The portions 11*a* and 11*b* provide a laterally long space 11*c*. The strip-like piece 11 can be used as a handle when, for example, the chair 1 is moved. The strip-like piece 11 is not limited to the above-described configuration and may comprise only the strip-like portion as shown in FIG.

4A. In other words, a configuration may be adopted in which no laterally long space is provided in a top-end area of the backrest 10.

Figure 2A:
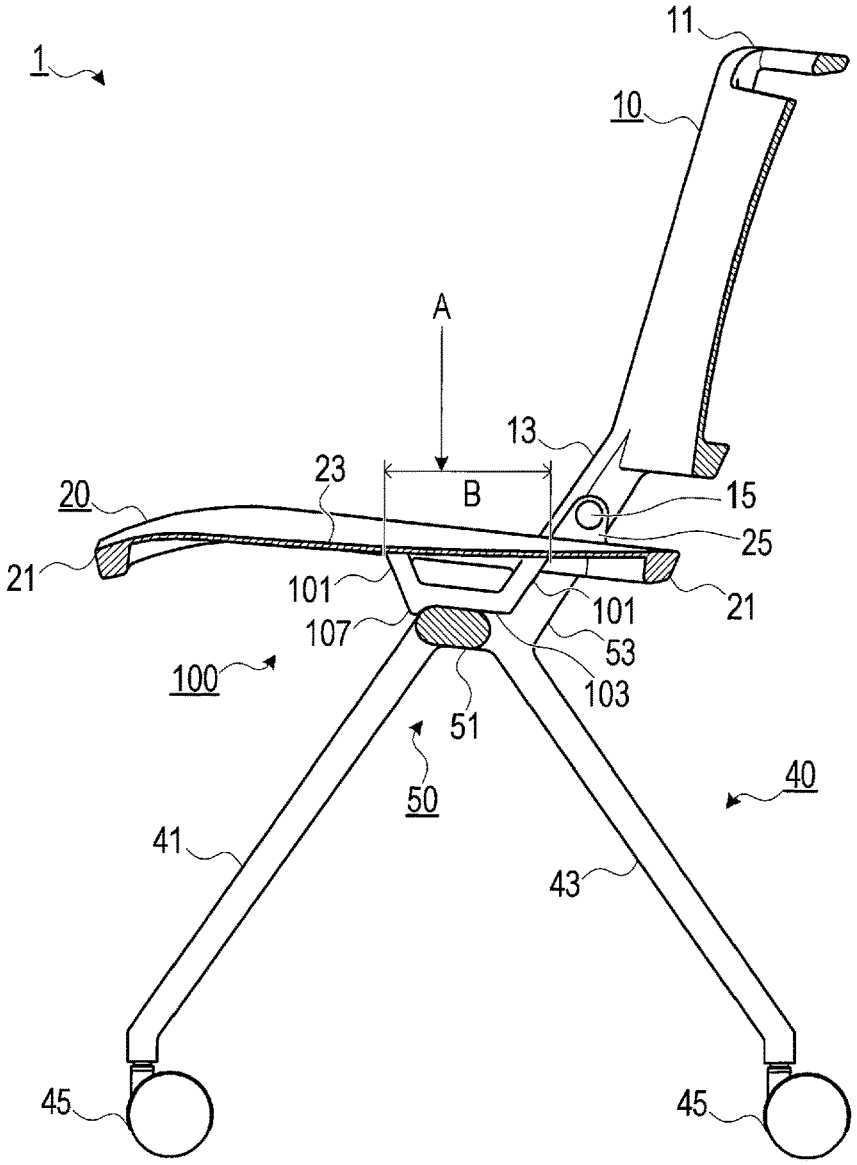
FIGS. 2A and 2B are cross-sectional views along line II-II of a front view.
Figure 3A:
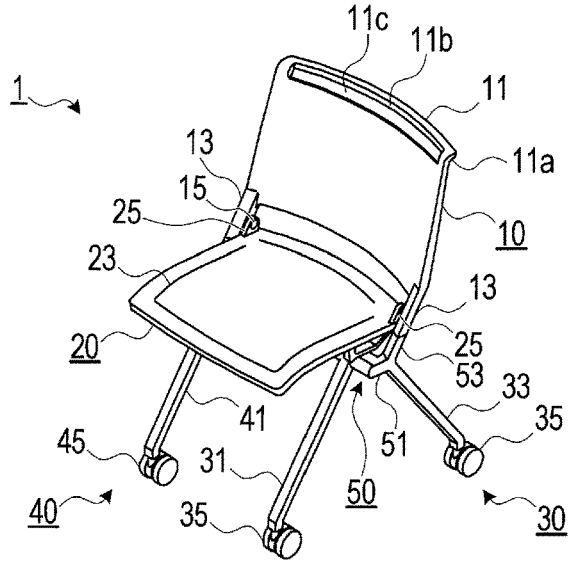
FIGS. 3A-3C are perspective views illustrating characteristic portions of the chair.
Figure 3B:
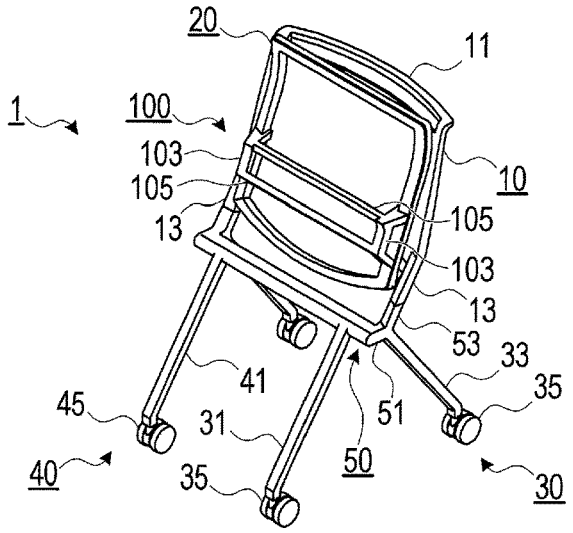

The pair of backrest-side connecting pieces 13 is provided to the backrest 10 in a positional relationship that allows a rear end of the seat body 20 to be held between both connecting pieces 13 from left and right. As shown in FIG. 2A, the pair of backrest-side connecting pieces 13 fixes the seat body 20 rotatably about an axis body 15 extending in the left-right direction. This configuration enables a rotation of the seat body 20 between an in-use state (FIG. 3A) and a stored state (FIG. 3B). The in-use state a state in which the seat body 20 is pulled down to locate the seating surface approximately parallel to the surface on which the chair 1 is placed. The stored state is a state in which the seat body 20 is flipped up to locate the seating surface approximately vertical to the surface on which the chair 1 is placed. "Being approximately parallel" and "being approximately vertical" here do not mean to be completely parallel and completely vertical, respectively.

Figure 3C:
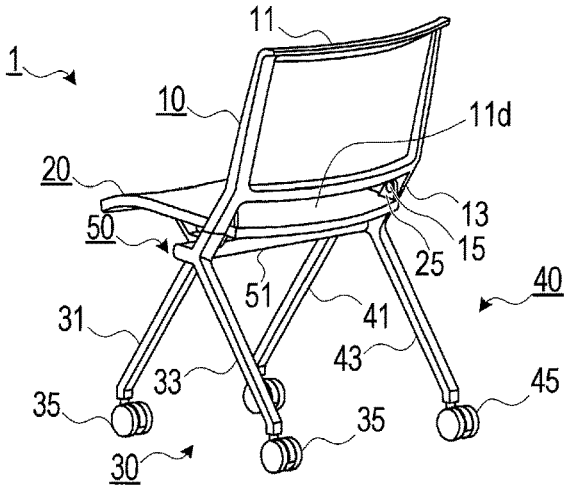

The backrest 10 is supported above the seat body 20 by the support frame 50. This configuration provides a laterally long space 11*d* between the rear end of the seat body 20 and the bottom end of the backrest 10 as shown in FIG. 3C.

Figure 2B:
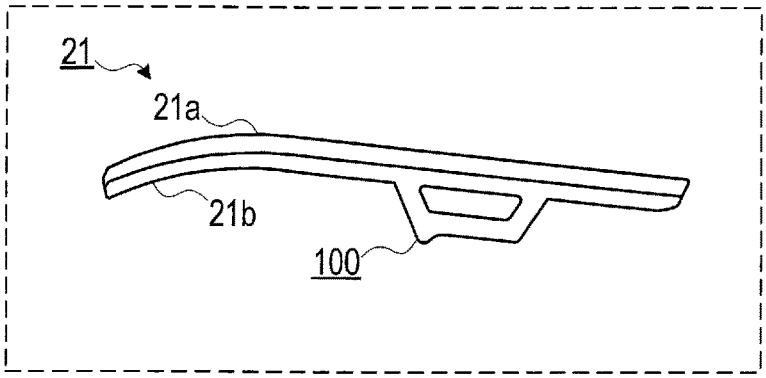

The seat body 20 is configured where a sheet-like member 23 to be used as a seating surface is stretched across an area enclosed in a frame body 21 that is rectangular in a plan view (see FIG. 1A, etc.). According to the present embodiment, the frame body 21 comprises a top frame body 21*a* and a bottom frame body 21*b* as shown in FIG. 2B. The top frame body 21*a* and the bottom frame body 21*b* are stacked in a top-bottom direction (up-down direction). Detailed description being omitted, the sheet-like member 23 is stretched across the top frame body 21*a*. The bottom frame body 21*b* is provided with a pair of positioning members 100 described below. The seat body 20 comprises a tilted surface with a gradient rising from the rear end to the front end of the seat body 20 in the in-use state (see FIG. 1C). The front end of the seat body 20 has a suspended portion 20*a* suspending downward.

The seat body 20 is provided with a pair of seat-side fixing pieces 25 to fix the seat body 20 to the backrest 10 (one seat-side fixing piece 25 on a left side and the other seat-side fixing piece 25 on a right side of the rear end of the seat body 20) at positions of the seat body 20 that correspond to the pair of backrest-side connecting pieces 13 of the backrest 10. Passing the axis body 15 described above through the pair of seat-side fixing pieces 25 to fix the seat body 20 and the backrest 10 to each other permits the entire seat body 20 to rotate with respect to the backrest 10 (see FIGS. 3A and 3B).

The pair of positioning members 100 is provided to the frame body 21 on back surfaces of a left piece and a right piece thereof extending in the front-rear direction respectively on a left side and a right side thereof, one positioning member 100 on each of the respective back surfaces of the pieces. The pair of positioning members 100 positions the seat body 20 to be in a seatable state.

The pair of positioning members 100 protrudes from a back surface of the seat body 20, and each has a shape in which a front-rear width thereof is made narrower toward a far side from the seat body 20 in a side view (a trapezoidal shape according to the present embodiment). An amount of protrusion of the pair of positioning members 100 from the seat body 20 is determined so that a lowest part of the sheet-like member 23 at the time the sheet-like member 23 is deformed when a user sits down is brought into a positional relationship in which the pair of positioning members 100 contacts the support frame 50 while the lowest part of the sheet-like member 23 is located above a top of the support frame 50. The pair of positioning members 100 protrudes from the back surface of the seat body 20 in such a manner as to be inclined inward in the left-right direction, thereby contacting the support frame 50 at positions within an outer left side and an outer right side of the seat body 20 (see FIG. 1B).

Figure 4A:
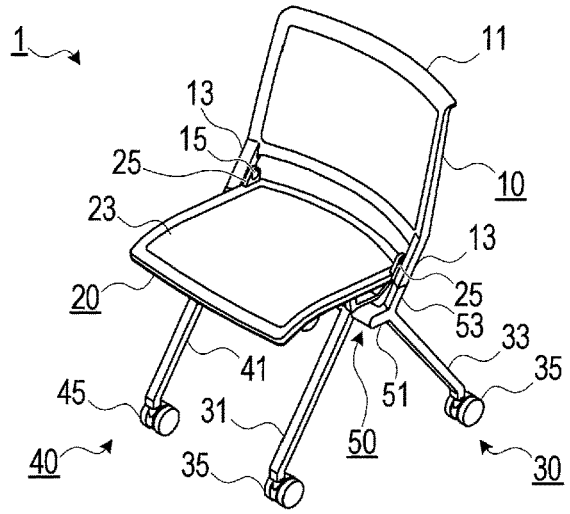
FIGS. 4A-4C are perspective views illustrating characteristic portions of a chair in another embodiment.
Figure 4B:
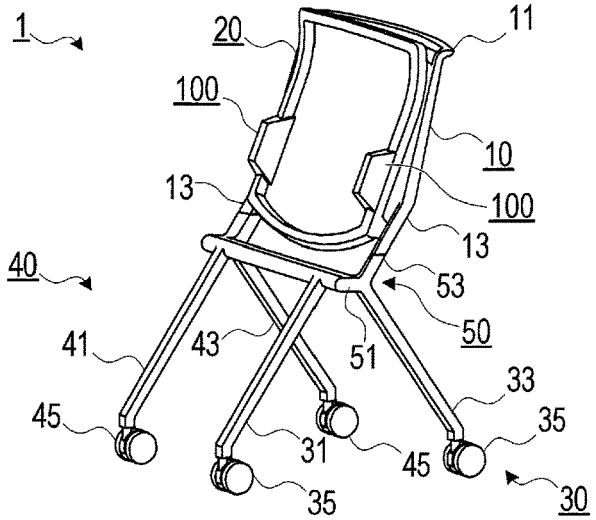

The positioning member 100 comprises a set of protruding pieces 101 and a connecting piece 103. The set of protruding pieces 101 is configured as described below. Specifically, as shown in FIG. 2A, in a case where a front-rear position in the seat body 20 that corresponds to ischial tuberosities of a seated person (i.e., a position along the front-rear direction in which ischial tuberosities of a seated person are assumed to be located) is assumed as a reference position A, the set of protruding pieces 101 is configured to protrude from a back surface of the frame body 21, one protruding piece 101 from a front end and the other protruding piece 101 from a rear end of a given region B that includes the reference position A and extends in the front-rear direction on the back surface thereof. The connecting piece 103 connects the set of protruding pieces 101 to each other at their respective ends. Positioning of the seat body 20 is achieved by contact of the connecting piece 103 with the support frame 50. The positioning member 100 is not limited to the configuration including the set of protruding pieces 101 and the connecting piece 103, and may be, for example, a protrusion that protrudes from the entirety of the given region B on the back surface of the frame body 21, as shown in FIG. 4B.

Figure 4C:
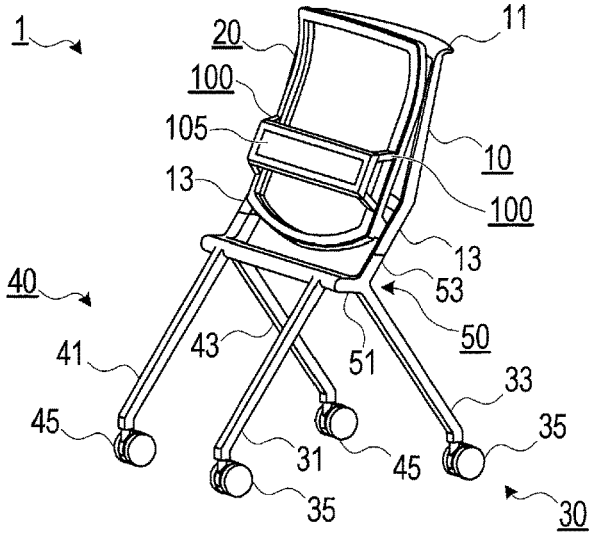
Figure 6A:
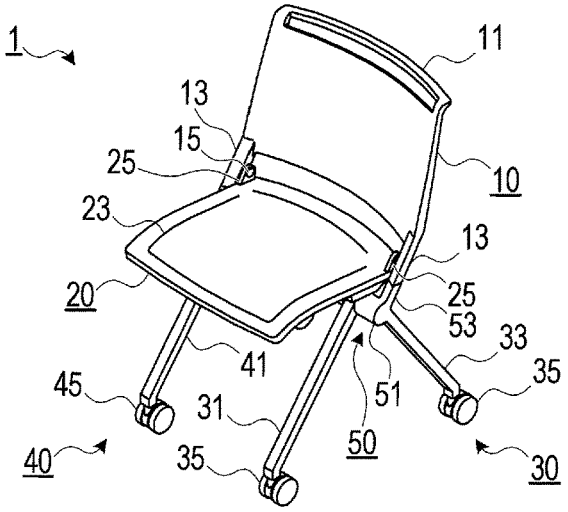
FIGS. 6A-6C are perspective views illustrating characteristic portions of a chair in still another embodiment.
Figure 6B:
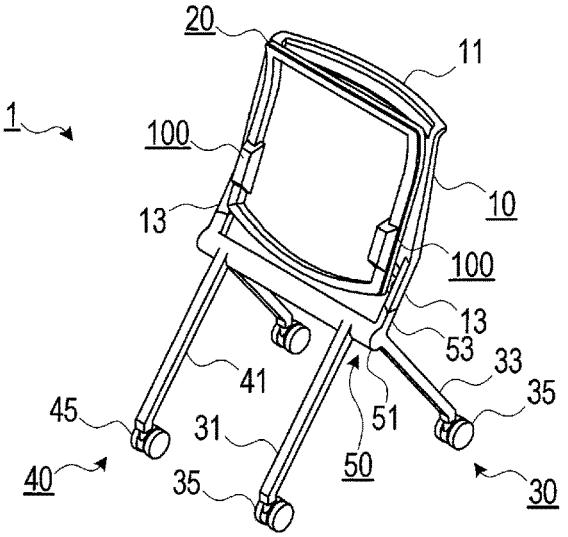
Figure 6C:
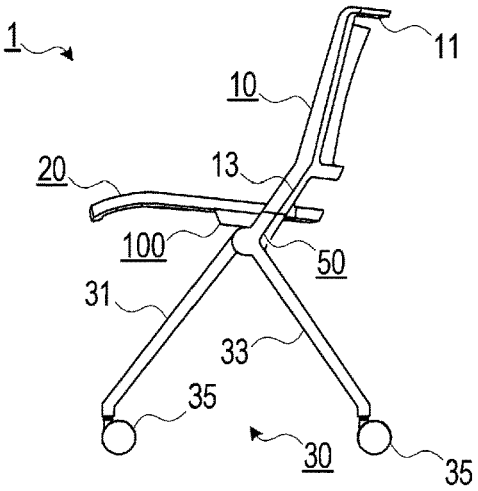

The pair of positioning members 100 is connected to each other by reinforcing frames 105 extending in the left-right direction, as shown in FIG. 3B. The reinforcing frames 105 are shown to be configured to connect the pair of positioning members 100 to each other only at respective front ends and rear ends of both positioning members 100, but are not limited to this configuration. A plate-like member may be used as a reinforcing frame 105, as shown in FIG. 4C. Specifically, a configuration may be adopted in which the reinforcing frame 105 connects the pair of positioning members 100 to each other along the entire front-rear width of both positioning members 100. Alternatively, no reinforcing frame 105 may be provided as shown in FIG. 6B.

The positioning member 100 has a height that is determined so that a lowest part of the sheet-like member 23 deformed under the load as in the static strength test or the shock resistance test defined by the Japanese Industrial Standards (S1203) concerning the test methods for strength and durability of chairs does at least not contact an upper surface of the support frame 50 (the height being the amount of protrusion from the back surface of the frame body 21, which is specifically 50 mm as a height (amount of protrusion) according to the size of the load and the elasticity of the sheet-like member 23). The configuration in which the lowest part of the seat body 20 (the lowest part of the sheet-like member 23) under the above-described load does not contact the upper surface of the support frame 50 does not cause the lowest part of the sheet-like member 23 to contact the upper surface of the support frame 50 when the sheet-like member 23 is deformed by a user who weighs as much as or less than the load.

The leg parts 30, 40 respectively comprise front legs 31, 41, rear legs 33, 43, and casters 35, 45. The front legs 31, 41 are provided to extend obliquely forward from the bottoms of end portions of the support frame 50. The rear legs 33, 43 are provided to extend obliquely backward from the bottoms of end portions of the support frame 50, the end portions being located outside those of the front legs 31, 41. The casters 35, 45 are provided to the bottom ends of the legs. Thus, a leg body is configured where the support frame 50 is supported by the leg parts 30, 40. A configuration may be adopted in which the chair 1 does not comprise the casters 35, 45.

The leg parts 30, 40 are configured so that a distance between the rear legs 33, 43 is larger than a distance between the front legs 31, 41. This configuration enables the chairs 1 of an identical shape to be stacked in the front-rear direction.

The support frame 50 comprises a plate-like main frame 51 extending in the left-right direction and a pair of support-side connecting pieces 53. The main frame 51 connects the leg parts 30, 40 to each other in the left-right direction. The pair of support-side connecting pieces 53 extends upward from the main frame 51 to be connected to the backrest 10, one support-side connecting piece 53 from a top of a left end and the other support-side connecting piece 53 from a top of a right end of the main frame 51. As shown in FIG. 2A, an upper surface of the main frame 51 (support frame 50) comprises a contact surface with the positioning member 100, and the main frame 51 (support frame 50) is provided so that part thereof contacts or intersects a line extended along a line corresponding to a front end of the positioning member 100 in a side view.

A front end of the main frame 51 is configured to include a curved surface sloped downward (in a semi-circular shape according to the present embodiment in a side view). The front end of the main frame 51 and a projection 107 provided to the far side of the positioning member 100 are configured to fit to each other.

Figure 5:
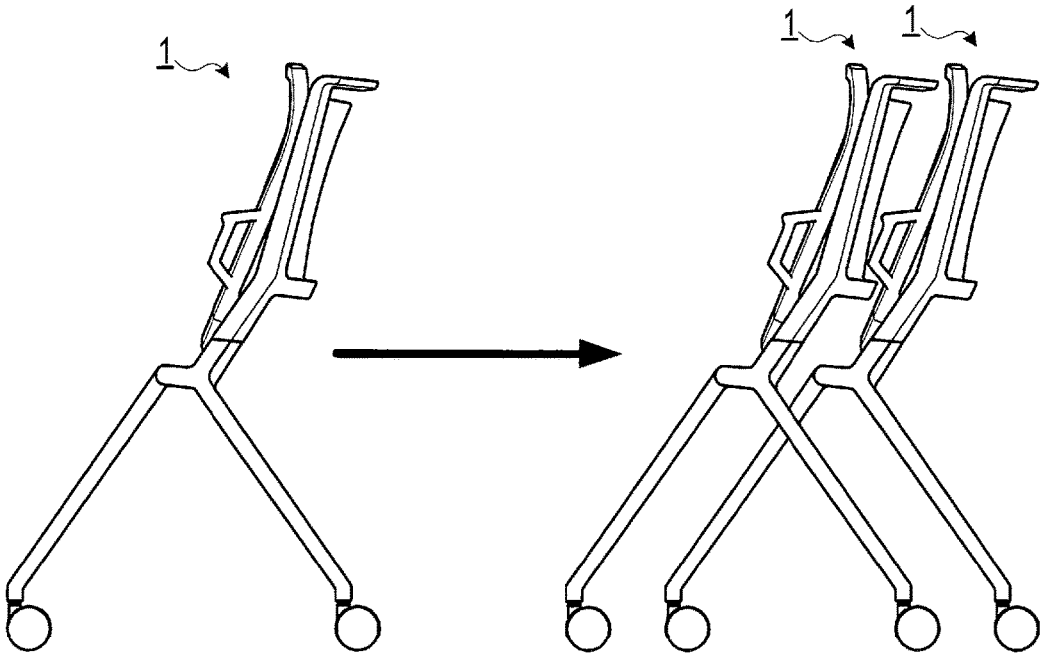
FIG. 5 is a view illustrating how a plurality of the chairs is brought into a nested state.

The chair 1 configured as above can be brought into the stored state by flipping up the seat body 20 so that the chairs 1 can be stacked in the front-rear direction, as shown in FIG. 5. The chair 1 configured as such can save the storage space when it is not in use (when it is stored).

(2) Modified Examples

Although the embodiment of the present invention has been described above, the present invention is not at all limited to the above-described embodiment and can be practiced in various forms without departing from the technical scope of the present invention.

For example, the above-described embodiment has been exemplified by the configuration in which the plate-like member extending in the left-right direction is employed as a main frame 51 of the support frame 50. However, the main frame 51 is not limited to this configuration, and a cylindrical member extending in the left-right direction, for example, may be employed as shown in FIG. 6B.

This configuration may be such as described below, in view of the fact that the positioning member 100 is easily elastically deformed along an outer circumferential curved surface of the main frame 51 (support frame 50). Specifically, the main frame 51 (support frame 50) may be configured and arranged so as not to contact or intersect the line extended along the line corresponding to the front end of the positioning member 100 in a side view.

Figure 7:
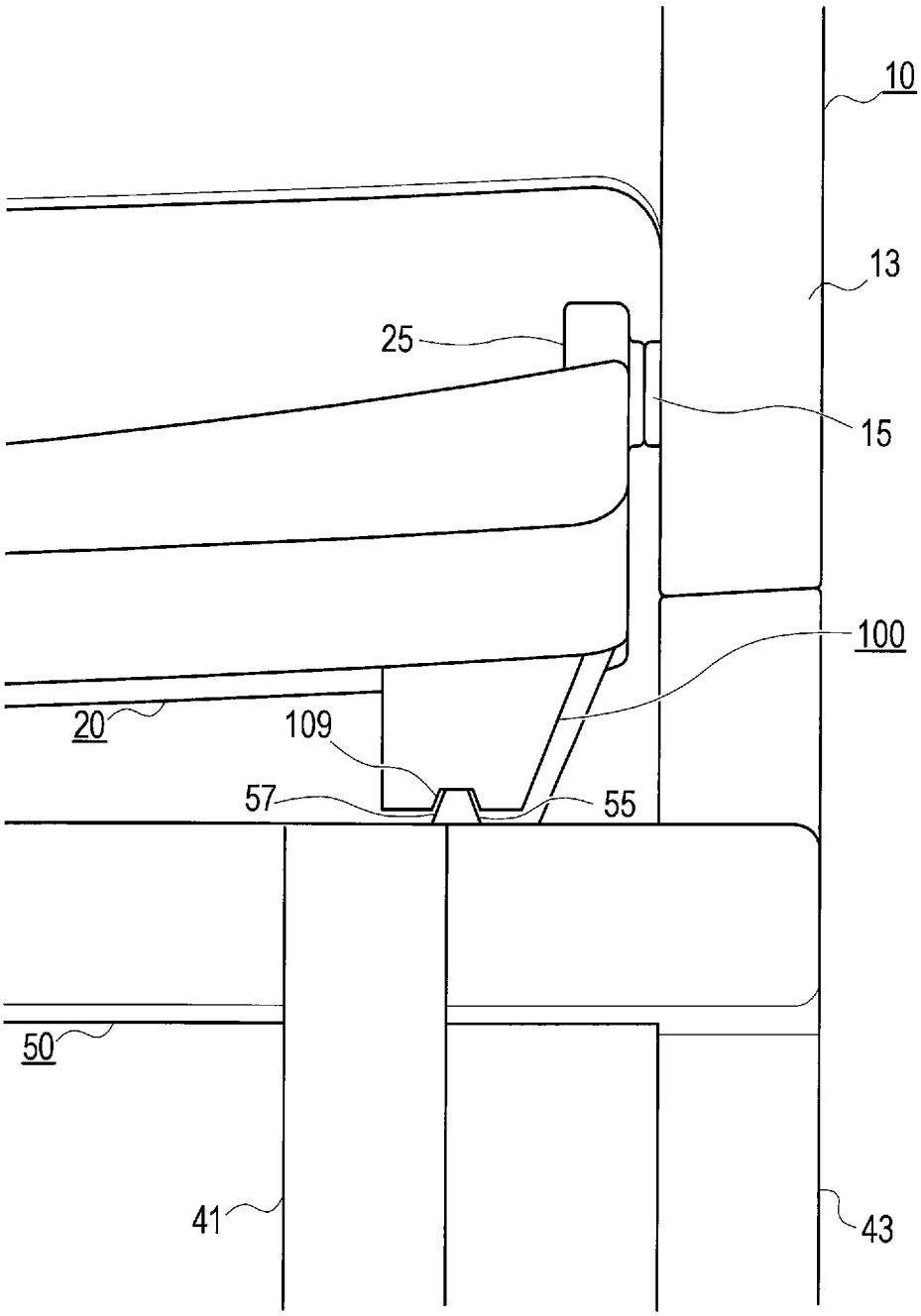
FIG. 7 is a front view illustrating main components of characteristic portions of a chair in still another embodiment.

According to the above-described embodiment, the contact area between the support frame 50 and the positioning member 100 may be configured as described below, from a viewpoint of positioning the seat body 20 and ensuring the strength of the chair 1. Specifically, as shown in FIG. 7, the support frame 50 may have an inward regulating piece 55 and/or an outward regulating piece 57 in an area thereof that is in or adjacent to the contact area with the positioning member 100. The inward regulating piece 55 regulates an inward displacement of the positioning member 100 in the left-right direction, and the outward regulating piece 57 regulates an outward displacement of the positioning member 100 in the left-right direction.

FIG. 7 shows an example where the support frame 50 is provided with a protrusion in which an outer side thereof in the left-right direction functions as the inward regulating piece 55 and an inner side thereof in the left-right direction functions as the outward regulating piece 57. According to this example, the positioning member 100 is provided with a positioning hole 109 to receive the protrusion that functions as the inward regulating piece 55 and the outward regulating piece 57. The inward regulating piece 55 and the outward regulating piece 57 may be configured as separate members or may be configured to be arranged, respectively, inside and outside the positioning member 100 in the left-right direction.

Figure 8:
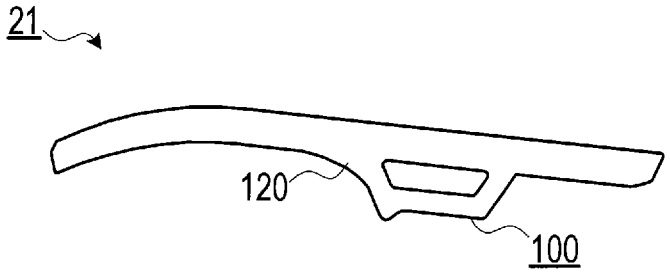
FIG. 8 is a right side view illustrating main components of a frame body of a seat body in still another embodiment.

The above-described embodiment has been exemplified by the configuration in which the positioning member 100 has a trapezoidal shape in which the front-rear width thereof is made linearly narrower toward the far side from the seat body 20 in a side view. However, the positioning member 100 may have any other shape in which the front-rear width thereof is made narrower toward the far side from the seat body 20. Specifically, as shown in FIG. 8, the positioning member 100 may be configured to further comprise an extended area 120 extending forward in a side view and to have a shape in which a front-rear width thereof including the extended area 120 is made narrower toward the far side from the seat body 20. The extended area 120 can be extended to a given position located between a front end surface of a main portion of the positioning member 100 and an area of the seat body 20 in which the seat body 20 starts to suspend downward.

The above-described embodiment has been exemplified by the configuration in which the leg body comprises the set of left and right leg parts 30, 40 and the support frame 50 connecting the leg parts 30, 40 to each other in the left-right direction, in which the support frame 50 is supported by the leg parts 30, 40. However, the leg body is only required to have a configuration in which the support frame 50 extending in the left-right direction is supported by the leg parts 30, 40 and is not limited to the configuration in the above-described embodiment.

Figure 9A:
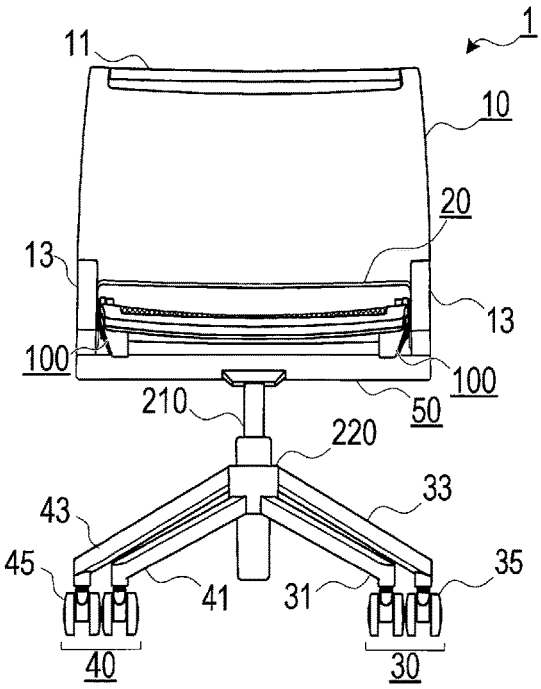
FIGS. 9A and 9B are a front view and a right side view illustrating an entire configuration of a chair in still another embodiment.
Figure 9B:
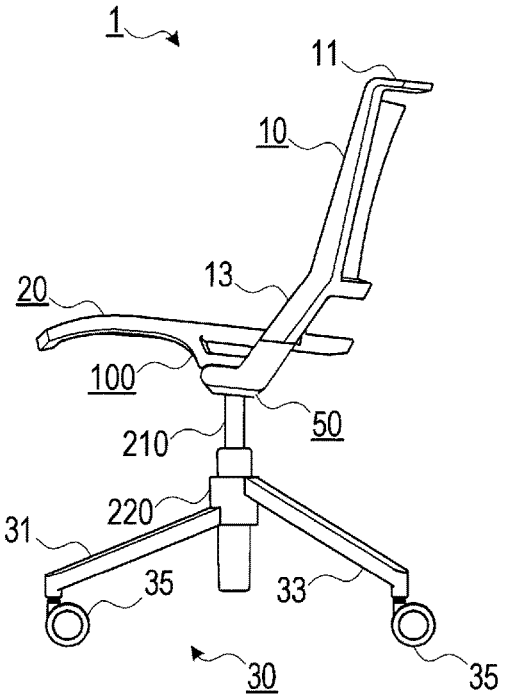

As shown in FIGS. 9A and 9B, for example, a configuration is possible in which the leg body comprises a support frame 50, an axis body 210 extending downward from below the support frame 50, and leg parts 30, 40 attached rotatably with respect to the axis body 210. According to this configuration, a cylindrical body 220 that can rotate about the axis body 210 and the legs 31, 41, 33, 43 of the leg parts 30, 40 that extend from an outer circumferential surface of the cylindrical body 220 in directions differing from each other can be provided. According to this configuration, a distance between the rear legs 33, 43 is generally larger than a distance between the front legs 31, 41. Further, the rear legs 33, 43 are provided to a higher position than a position of the front legs 31, 41.

Figure 10:
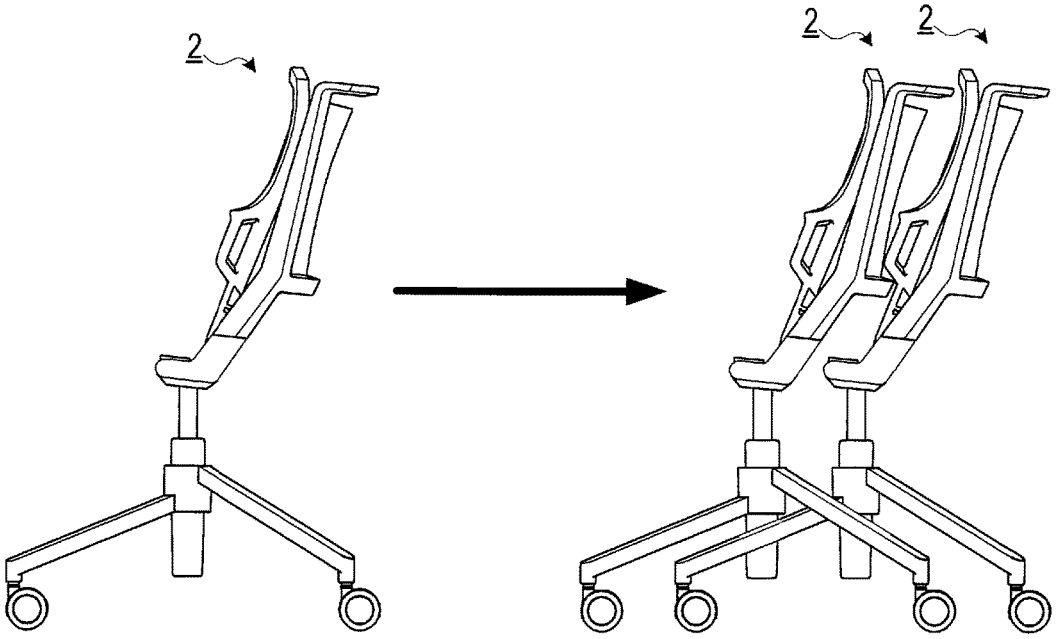
FIG. 10 is a view illustrating how a plurality of the chairs is brought into a nested state.

The chair 1 having such a leg body can be brought into the stored state by flipping up the seat body 20 so that the chairs 1 can be stacked in the front-rear direction, as shown in FIG. 10. This configuration enables the storage space to be saved when the chair 1 is not in use (when it is stored).

(3) Operation and Effect

According to the chair 1 configured as such, even when the sheet-like member 23 is deformed when the user sits on the seat body 20, the lowest part of the sheet-like member 23 does not contact the support frame 50 in spite of the structure being employed in which the load is received by the support frame 50 arranged directly under the seat body 20, and thus the deformation of the sheet-like member 23 caused when the user sits down is not hindered. This leads to advantageous improvement in the seating comfort of the chair 1 while ensuring the compactness thereof when it is not in use (when it is stored).

According to the chair 1 configured as described above, since the front-rear position in the seat body 20 that corresponds to the ischial tuberosities of a seated person, i.e., the position along the front-rear direction where the ischial tuberosities of a seated person are assumed to be located can be the position of the center of gravity of the seated person in the front-rear direction, it is effective that the load is received in the region B extending forward and backward from this position being the reference position A on the back surface of the frame body 21 of the seat body 20 so as to ensure the strength of the chair 1 when the user sits down. In this regard, the above-described configuration enables the load to be received by pair of the positioning members 100 in the region B that can include the position of the center of gravity of the seated person in the seat body 20, thus advantageously ensuring the strength of the chair 1 when the user sits down.

In the case where the positioning member 100 comprises the set of protruding pieces 101 and the connecting piece 103, elastic deformation can easily occur because of a frame-like structure formed by the set of protruding pieces 101 and the connecting piece 103. In such a case, a design in which the frame-like structure is elastically deformed only by a load that exceeds the load applied while the user is seated permits the chair to have the function of absorbing a large load caused when the user sits down.

According to the above-described configuration, since the front-rear width of the positioning member 100 is made narrower toward the far side from the seat body 20, the front-rear width of the area of the support frame 50 contacting the positioning member 100 can also be reduced according to the front-rear width of the positioning member 100, and thus, the compactness of the chair 1 can further be improved when it is not in use (when it is stored).

Further, according to the above-described configuration, connecting the pair of positioning members 100 to each other by the reinforcing frame 105 can further improve the strength of the chair 1 when the user sits down.

According to the above-described configuration, the contact of the pair of positioning members 100 with the support frame 50 at positions within the outer left side and the outer right side of the seat body 20 secures certain distances from the outer sides to the contact areas, which can result in reduced occurrence of an object being caught in the contact areas.

The configuration in which the support frame 50 is provided with the inner regulating piece 55 and/or the outer regulating piece 57 enables the user to securely and easily position the seat body 20 to be in a seatable state. This is because the inward regulating piece 55 and/or the outward regulating piece 57 of the support frame 50 are provided in an area that is in or adjacent to the contact area of the support frame 50 with the positioning member 100 so that the positional relationship between the support frame 50 and the positioning member 100 is clarified.

According to the configuration including the inward regulating piece 55, even in a case where the positioning member 100 is displaced inward in the left-right direction by the load applied when the user sits down, the inner regulating piece 55 regulates this displacement so that the strength of the chair 1 at the time the user sits down is further increased.

According to the configuration including the outward regulating piece 57, even in a case where the positioning member 100 is displaced outward in the left-right direction by the load applied when the user sits down, the outer regulating piece 57 regulates this displacement so that unintended deformation caused by such a load can be reduced.

According to the configuration in which the positioning member 100 is configured to comprise the extended area 120 and to have a shape in which the front-rear width thereof including the extended area 120 is made narrower toward the far side from the seat body 20, the front ends of both positioning members 100, each front end including the extended area 120, support and reinforce the left side and the right side of the seat body 20 from the back. In such a case, the strength of the seat body 20 can be improved. In addition, since the seat body 20 bends gradually more toward its front end, the deformation of the seat body 20 caused by contact of the legs (especially, the back of the thighs) of the seated person is less likely to be hindered. This results in increased seating comfort.

What is claimed is:

1. A chair comprising:

a pair of left and right leg portions; and a support frame that connects the pair of left and right leg portions, wherein the support frame comprises:

a main body extending in a left-right direction and having a cross-section definable along a plane perpendicular to a normal direction that is the left-right direction, the cross-section being longer in a first direction than in a second direction perpendicular to the first direction; and backrest supporting pieces that respectively extend from left and right regions of the main body so as to support a backrest;

wherein the pair of left and right leg portions comprises:

front legs extending forwardly and downwardly from the main body; and rear legs extending rearwardly and downwardly from the main body; and wherein, relative to the rear legs, the front legs are medially inset to respectively extend from the main body at positions located closer to a center portion of the main body.

2. The chair according to claim 1, further comprising a seat body secured in a manner so as to be rotatable about an axis extending in the left-right direction, wherein the seat body comprises at least one positioning member provided on a back surface and protruding therefrom so as to contact the support frame and thereby to position the seat body to be in a seatable state.

3. The chair according to claim 1, wherein the first direction is substantially a front-rear direction.

4. The chair according to claim 1, wherein the front legs extend from a front end of the main body, and wherein the rear legs extend from a rear end of the main body.

5. The chair according to claim 1, wherein left and right end surfaces of the main body, left and right outer surfaces of the backrest supporting pieces, and left and right outer surfaces of portions of the rear legs connected to the main body are respectively flush with one another on corresponding planes perpendicular to the normal direction.

6. A chair comprising:

a pair of left and right leg portions; and a support frame that connects the pair of left and right leg portions, wherein the support frame comprises:

a main body extending in a left-right direction and having a cross-section definable along a plane perpendicular to a normal direction that is the left-right direction, the cross-section being longer in a first direction than in a second direction perpendicular to the first direction; and backrest supporting pieces that respectively extend from left and right regions of the main body so as to support a backrest;

wherein the pair of left and right leg portions comprises:

front legs extending forwardly and downwardly from the main body; and rear legs extending rearwardly and downwardly from the main body; and wherein the main body and the backrest supporting pieces comprise a unitary, one-piece assembly.

7. The chair according to claim 6, wherein the unitary, one-piece assembly further comprises the front legs and the rear legs.

8. A chair comprising:

a pair of left and right leg portions; and a support frame that connects the pair of left and right leg portions, wherein the support frame comprises:

a main body extending in a left-right direction and having a cross-section definable along a plane perpendicular to a normal direction that is the left-right direction, the cross-section being longer in a first direction than in a second direction perpendicular to the first direction; and backrest supporting pieces that respectively extend from left and right regions of the main body so as to support a backrest;

wherein the pair of left and right leg portions comprises:

front legs extending forwardly and downwardly from the main body; and rear legs extending rearwardly and downwardly from the main body; and wherein left and right end surfaces of the main body, left and right outer surfaces of the backrest supporting pieces, and left and right outer surfaces of portions of the rear legs connected to the main body are respectively flush with one another on corresponding planes perpendicular to the normal direction.

9. A chair comprising:

a pair of left and right leg portions; and a support frame that connects the pair of left and right leg portions, wherein the support frame comprises:

a main body extending in a left-right direction and having a cross-section definable along a plane perpendicular to a normal direction that is the left-right direction, the cross-section being longer in a first direction than in a second direction perpendicular to the first direction; and backrest supporting pieces that respectively extend from left and right regions of the main body so as to support a backrest;

wherein the pair of left and right leg portions comprises:

front legs extending forwardly and downwardly from the main body; and rear legs extending rearwardly and downwardly from the main body; and wherein the first direction is substantially a front-rear direction, the front legs extend from a front end of the main body, the rear legs extend from a rear end of the main body, and the main body comprises a flat upper surface.

* * * * *